US008333871B2

(12) United States Patent
Tsavalas et al.

(10) Patent No.: US 8,333,871 B2
(45) **Date of Patent: *Dec. 18, 2012**

(54) PAPER MANUFACTURING USING AGGLOMERATED HOLLOW PARTICLE LATEX

(75) Inventors: John Tsavalas, Hockessin, DE (US); John A. Roper, III, Midland, MI (US); Carleton L. Gaupp, Midland, MI (US); James G. Galloway, Midland, MI (US)

(73) Assignee: OMNOVA Solutions Inc., Fairlawn, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/048,115

(22) Filed: Mar. 15, 2011

(65) Prior Publication Data

US 2011/0162812 A1 Jul. 7, 2011

Related U.S. Application Data

(63) Continuation of application No. 11/661,056, filed as application No. PCT/US2005/030039 on Aug. 24, 2005, now Pat. No. 7,914,647.

(60) Provisional application No. 60/604,230, filed on Aug. 25, 2004.

(51) Int. Cl.
*D21H 21/54* (2006.01)
*C04B 16/02* (2006.01)
*C04B 16/08* (2006.01)

(52) U.S. Cl. ..... 162/164.1; 162/158; 162/185; 106/409; 428/304.4; 428/313.5

(58) Field of Classification Search ..... 162/164.1, 162/158, 185; 106/409; 428/304.4, 315.5
See application file for complete search history.

(56) References Cited

U.S. PATENT DOCUMENTS

| | | | | |
|---|---|---|---|---|
| 4,058,434 | A * | 11/1977 | Vincent et al. | 162/165 |
| 4,087,581 | A * | 5/1978 | Vincent et al. | 428/327 |
| 4,239,646 | A * | 12/1980 | Vincent et al. | 428/402.21 |
| 4,264,742 | A * | 4/1981 | Golden et al. | 521/64 |
| 4,427,836 | A | 1/1984 | Kowalski et al. | |
| 4,450,123 | A * | 5/1984 | Egawa et al. | 264/4.7 |
| 4,477,518 | A | 10/1984 | Cremona et al. | |
| 4,594,363 | A | 6/1986 | Blankenship et al. | |
| 4,972,000 | A * | 11/1990 | Kawashima et al. | 521/54 |
| 5,082,895 | A * | 1/1992 | Wolff et al. | 524/820 |
| 5,157,084 | A | 10/1992 | Lee et al. | |
| 5,190,983 | A * | 3/1993 | Bito et al. | 521/56 |
| 5,360,827 | A * | 11/1994 | Toda et al. | 521/57 |
| 6,042,936 | A | 3/2000 | Kempf | |
| 6,139,961 | A | 10/2000 | Blankenship et al. | |
| 6,221,956 | B1 * | 4/2001 | Chen | 524/814 |
| 6,261,483 | B1 * | 7/2001 | Frank et al. | 264/4.1 |
| 6,355,141 | B1 * | 3/2002 | Sikkar et al. | 162/181.9 |
| 6,379,497 | B1 | 4/2002 | Sandstrom et al. | |
| 6,547,929 | B2 * | 4/2003 | Bobsein et al. | 162/135 |
| 6,624,272 | B2 * | 9/2003 | Futami et al. | 526/307.3 |
| 7,579,081 | B2 * | 8/2009 | Brown | 428/405 |
| 7,914,647 | B2 * | 3/2011 | Tsavalas et al. | 162/164.1 |
| 2001/0038893 | A1 | 11/2001 | Mohan et al. | |
| 2002/0014632 | A1 | 2/2002 | Kaneyama et al. | |
| 2003/0130418 | A1 * | 7/2003 | Hamilton et al. | 525/50 |
| 2004/0034147 | A1 | 2/2004 | Zama | |

FOREIGN PATENT DOCUMENTS

| | | | |
|---|---|---|---|
| EP | 978312 | A1 * | 2/2000 |
| EP | 1039025 | A1 | 9/2000 |
| JP | 51076384 | A | 7/1976 |
| JP | 62263400 | A | 11/1987 |
| JP | 3074440 | A | 3/1991 |
| JP | 8259701 | A | 10/1996 |
| JP | 2000045200 | A | 2/2000 |
| JP | 2000160496 | A | 6/2000 |
| JP | 2000212890 | A | 8/2000 |
| JP | 2001248094 | A | 9/2001 |
| WO | 0160510 | A1 | 8/2001 |

OTHER PUBLICATIONS

International Search Report for technology related International Appl. No. PCT/US2005/030039 dated Dec. 15, 2005; 3 pages.
International Preliminary Report on Patentability for technology related International Appl. No. PCT/US2005/030039 dated Feb. 28, 2007; 5 pages.
Translation of the Office Action issued Apr. 18, 2011 in technology related application Japanese Patent Application No. 2007-530067; 2 pages.

* cited by examiner

*Primary Examiner* — Matthew Daniels
*Assistant Examiner* — Dennis Cordray
(74) *Attorney, Agent, or Firm* — Arthur M. Reginelli; David G. Burleson

(57) ABSTRACT

Agglomerated hollow particle latex is employed as a filler in the wet end of the paper-making process to provide paper with improved properties.

10 Claims, 6 Drawing Sheets

PAPER MANUFACTURING USING AGGLOMERATED HOLLOW PARTICLE LATEX

CROSS REFERENCE TO RELATED APPLICATIONS

Continuation of U.S. patent application Ser. No. 11/661,056, filed on Feb. 22, 2007, now U.S. Pat. No. 7,914,647 which claims the benefit of PCT/US2005/030039 filed Aug. 24, 2005, which claims the benefit of U.S. Provisional Application Ser. No. 60/604,230, filed Aug. 25, 2004.

BACKGROUND OF THE INVENTION

This invention relates to the manufacture of low density paper products.

The paper manufacturing process is very old. In recent years there has been an increasing demand for printing papers having excellent physical properties. On the other hand, there is a great demand for weight reduction in these papers for the sake of reduced cost in transportation and mailing. These demands historically have been mutually contradictory, given that higher quality papers conventionally have a higher base paper basis weight, and higher coat weight if a coating is applied. A paper with a lower basis weight may be selected in order to reduce the weight of a paper article made therefrom, but that is not an ideal solution since it will result in thinner paper and diminish the feeling of bulk expected from a paper product. It is further desired when decreasing the basis weight of a paper to maintain the stiffness of the paper at a lower sheet thickness. For these reasons, the market is presently demanding high quality paper articles that offer greater paper thickness at a given basis weight or a lower basis weight at a given paper thickness.

In the course of manufacturing paper and similar products, such as paper board, it is well known to incorporate inorganic fillers into the fibrous web in order to improve the quality of the resulting product. The fillers are important in improving the printing qualities of the paper by improving the surface characteristics, and the use of an appropriate filler vastly improves the opacity and brightness of a paper sheet. A number of inorganic materials have long been known to be effective for this purpose but despite the effectiveness of these inorganic fillers lower density replacements have been much sought after.

Modern paper manufacturers are constantly searching for a way to obtain paper having lower density while maintaining desired mechanical properties, thermal insulation and optical properties. Various approaches have been tried, including the use of various organic and inorganic materials as fillers.

The use of polymeric microspheres as a filler for paperboard is disclosed in U.S. Pat. No. 6,379,497 B1. U.S. 2002/014632 A1 discloses the use of expandable microspheres in the manufacture of opaque tissue paper. U.S. 2001/0038893 A1 teaches that expanded microspheres can be used in the manufacture of a low density paperboard material having insulating properties. Japanese published patent applications 2000-053351, 01-210054 and 11-006466 disclose the use of a hollow polymer particle in the wet-end of the paper-making where the hollow particle is cationic in nature. Japanese published patent application 2000-160496 teaches the use in the wet-end of the paper-making process of a composite hollow particle obtained by the adsorbtion of a high molecular weight amphoteric polyelectrolyte onto the surface of a hollow particle. However, the amount of treated composite hollow particle that is retained in the paper is to low to be practical. An additive to the paper manufacture process must be retained by the sheet in order to function properly. U.S. Pat. No. 6,139,961 discloses the incorporation of hollow sphere organic pigment into the formed wet sheet for improving the strength and opacity of the paper.

The problem of low cost manufacturing of a paper product simultaneously having high bulk and enhanced optical properties while maintaining acceptable mechanical properties has not been solved in the prior art.

SUMMARY OF THE INVENTION

The present invention involves a process for making a paper material, the process comprising forming an aqueous slurry comprising a predominantly cellulosic fiber pulp, forming a wet sheet from the slurry, and drying the sheet, the improvement comprising using an agglomerated hollow particle latex in the slurry. The invention also includes a composition comprising an agglomerated hollow particle latex, as well as paper materials made by the process of the invention. Surprisingly, the invention provides paper materials having a good combination of optical and mechanical properties, tactile properties, smoothness, and bulk.

DETAILED DESCRIPTION OF THE INVENTION

Figure 1A:
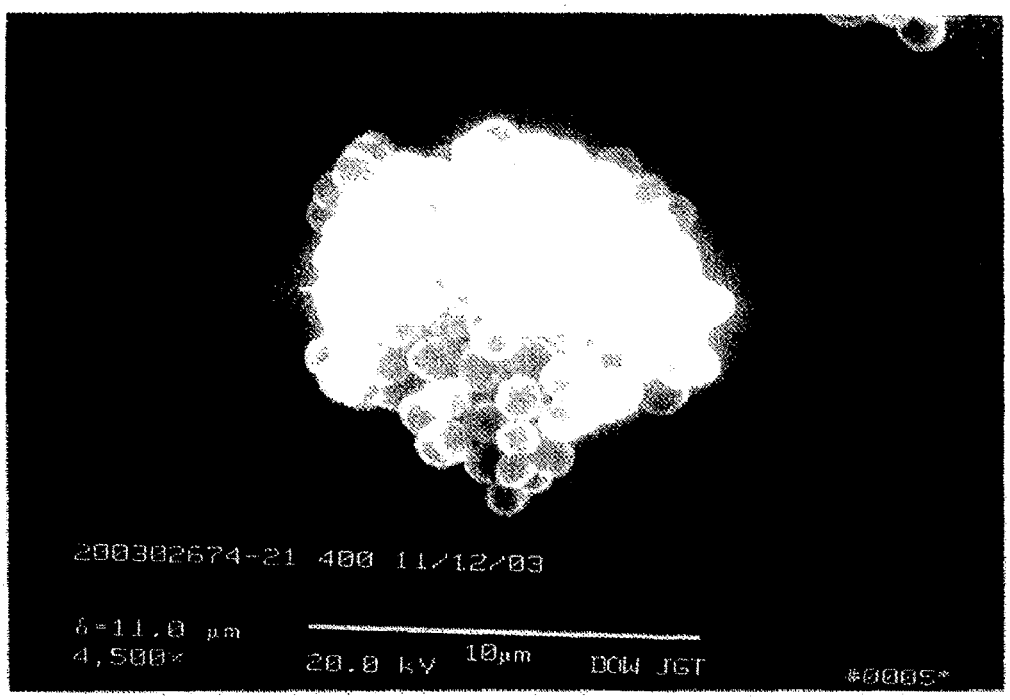
FIGS. 1A and 1B are electron micrographs of agglomerated hollow particle latex.

The paper-making process of the invention employs agglomerated hollow particle latex, which can be prepared from a hollow particle latex.

Hollow particle latexes are well-known and are commercially available. The hollow particle latex employed in the preparation of agglomerates can be prepared by any suitable process. Many such processes are known to those skilled in the art. See, for example, U.S. Pat. Nos. 4,427,836, 4,594,363 and 5,157,084. The hollow particle latexes can have an acid-containing core or an acid-free core. Examples of hollow particle latexes include HS 3000 brand latex available from The Dow Chemical Company, and Rhopaque HP 1055 brand latex available from Rohm and Haas Company. Advantageously, the hollow particle latex employed in the agglomeration process has an average particle size of from 0.1 to 10 microns. The particle size distribution of the hollow particle latex employed in the agglomeration process is not critical to performance of the agglomerated hollow particle as a filler in paper coatings.

Most commercially available hollow particle latexes have from 20 to 40 weight percent solids. A wide range of possible void volumes for the hollow particle latex enables a wide range of filler density. The range of void volume for the hollow particle latex preferably is from 10 to about 70 volume percent, more preferably is from 30 to about 60 volume percent, and most preferably is from to about 40 to about 55 volume percent. Mixtures of hollow particle latexes can be employed. In one embodiment of the invention, agglomerates can be prepared from a mixture of a hollow particle latex and another filler.

An agglomerating agent is employed to agglomerate the particles of the hollow particle latex. The choice of the agglomerating agent is determined by the desired charge or zeta potential of the agglomerated hollow particle latex. Suitable agglomerating agents include, for example: cationic surfactants such as cetyl pyridinium chloride, quaternary ammonium salts, and ethoxylated quaternary ammonium salts; positively or negatively or amphotertically charged polyelectrolytes such as cationic starch, cationic polyacrylamide, polyethyleneimine (PEI), polyacrylamide-co-acrylic acid, poly(diallyldimethylammonium chloride), (PDADMAC), and the like; neutral water-soluble polymers such as, for example, polyethylene oxide, (PEO), and partially hydrolyzed polyvinyl acetate; and agglomerating salts such as, for example, calcium chloride, zinc chloride, aluminum chloride, and ammonium sulfate. A colloidally stabilized particle to which the hollow particles adhere is also a suitable agglomerating agent. Examples of preferred agglomerating agents include cetyl pyridinium chloride and poly(diallyldimethylammonium chloride). Mixtures of agglomerating agents can be employed. The agglomerating agent is employed in an amount sufficient to form an agglomerated particle with an average particle diameter that is larger than the average particle size of the non-agglomerated latex. The amount of agglomerating agent advantageously is sufficient to convert at least about 30 weight % of the solids of the hollow particle latex to agglomerates, preferably at least about 50 weight %, more preferably at least about 75 weight % and most preferably at least about 90%. Preferably, from about 0.01 to about 1.0 grams of agglomerating agent is employed per gram of solids of the hollow particle latex, and more preferably from about 0.03 to about 0.5 grams of agglomerating agent is employed per gram of solids of the hollow particle latex.

The agglomeration is accomplished by contacting the agglomerating agent with the hollow particle latex under conditions sufficient to agglomerate the hollow particle latex. The contacting of the agglomerating agent with the hollow particle latex preferably is done at about morn temperature and atmospheric pressure with agitation. It may be advantageous to adjust the solids of the hollow particle latex for the agglomeration process in order to achieve the desired agglomerate density. It is possible to agglomerate the hollow particle latex at the paper producing site.

After formation, the agglomerated hollow particle latex may be further modified with the addition of a stabilizing agent. The purpose of the stabilizing agent is to prevent a further particle size increase by a ripening process, or further agglomeration due to high shear coagulation. Examples of suitable stabilizing agents include water-soluble polymers such as, for example, polyvinyl alcohol, carboxymethylcellulose, and starch. The preferred stabilizing agent is polyvinyl alcohol. Mixtures of stabilizing agents can be employed. The amount of stabilizer advantageously is from 0 to about 40% weight percent based on the weight of dry solids in the hollow latex.

The agglomerates employed in the invention are agglomerates of hollow particles of the hollow particle latex. The agglomerated particles typically are irregular and bumpy. The agglomerated particle latex preferably has a solids content of from about 1 to about 30% solids. As with the hollow particle latex, the solids for the agglomerated hollow particle latex employed in the wet-end of the paper-making process is not particularly critical due to the large dilution the agglomerated hollow particle latex undergoes when used as a filler in the wet-end. In one embodiment, the agglomerated hollow particles can be employed in the form of a dried, redispersible powder. The agglomerated hollow particle latex can be lower in density and higher in particle size than latexes that can be prepared using standard emulsion polymerization techniques. The larger particle size of the agglomerated hollow particle is advantageous in that the aggregates are more readily retained in the sheet during the paper-making process.

Advantageously, in one embodiment of the invention the agglomerates can be employed directly in existing paper formulations without the use of additional adjuvants, such as retention aids, and without modification of the surface of the particle. In another embodiment of the invention, additional adjuvants can be employed if desired. If the agglomerates are not retained, build up of filler in the aqueous make-up of the fiber dilution system of the paper-making process will eventually have a negative effect on the performance of the filler. Advantageously, the amount of agglomerated hollow particle latex retained in the paper product is at least about 80 weight percent based on the weight of agglomerated hollow particle latex added to the paper-making process. In various embodiments of the invention, the amount retained is at least about 85 weight percent based on the weight of agglomerated hollow particle latex added to the paper-making process, at least about 90%, or at least about 95%.

Retention aids may be added to enhance retention of the agglomerated hollow. Cationic retention aids are preferred but anionic ones my be used. Suitable retention aids are well known to those skilled in the art, and include materials such as, for example, polyacrylamide, and water soluble polymeric reaction products of epihalohydrins. Suitable materials of this type are commercially available under trademarks PERCOL, KYMENE or CASCAMID.

The agglomerated hollow particle latex preferably has an average particle size of from about 3 to about 100 microns, more preferably from about 5 to about 80 microns and most preferably from about 5 to about 50 microns. The stability of the agglomerate is determined by monitoring light scattering particle size distribution after shearing the agglomerate in a high speed blender for one minute. It is preferred that the agglomerate particle size and particle size distribution is substantially unchanged by the blender. Mixtures of agglomerated hollow particle latexes can be employed.

The void volume of the hollow particle latex along with the interstitial void in the aggregate allows the density of the agglomerated hollow particle latex to be adjusted to the specific filler need of the paper product. The total void volume in the aggregate preferably is from about 30 to about 90 volume percent, and more preferably is from about 40 to about 80 volume percent.

The agglomerated hollow particle latex can be stabilized with surfactant or a water-soluble polymer that interacts with the surface of the agglomerate. The net surface charge of the agglomerated hollow particle latex can be either negative or positive. The agglomerated hollow particle latex particle can be further characterized as having a positive, neutral or negative zeta potential.

The paper-making process is well known to those skilled in the art. The agglomerated hollow particle latex advantageously is employed as a filler in the wet end of the paper-making process. The addition of wet-end chemicals and filler can be accomplished through a variety of means. The agglomerated hollow particle latex can be added in the wet end anywhere, such as in the wet formed web, in the fan pump, in the thick stock loop, or elsewhere in the paper machine, or in any combination of these. It is preferred to add the agglomerated latex in an area of the process where the stock is diluted, such as the mix tank, the fan pump or before the head box. An alternative is to add the agglomerated latex in a location where fiber concentration is high such as, for example, the thick stock loop or the blend chest.

The amount of agglomerated particles employed in the paper-making process is dependent on the grade of paper being made and is limited by the volume of the low density filler material. Preferably, the level of usage is from about 0.5 to about 50 parts of agglomerated hollow particles per 100 weight parts of fiber, more preferably from about 0.75 to 25 parts, and most preferably from about 1 to about 20 parts. The agglomerated hollow particle latex can be employed as the sole filler or can be employed with other fillers, such as synthetic magadiite kaolin, titanium dioxide, ground calcium carbonate, precipitated calcium carbonate, and including low density materials such as, for example, hollow particle latex, hollow calcium carbonate or calcined kaolin clay. In various embodiments of the invention, the agglomerated hollow particle latex comprises at least about 10% of the total filler by weight, at least about 20% of the total filler by weight, at least about 50% of the total filler by weight, or at least about 80% of the total filler by weight.

The use of agglomerated hollow particle latex surprisingly can result in paper having a unique combination of properties, such as bulk, opacity and brightness, compared to paper produced using only mineral pigments or solid polymer pigments.

Specific Embodiment of the Invention

The following examples are included to illustrate the invention, and do not limit the scope of the claims. All parts and percentages are by weight unless otherwise stated.

EXAMPLE 1

Preparation of Agglomerated Hollow Particle Latex

Starting Materials:

HS3000 (CAS#214154-63-9) from The Dow Chemical Company.

Cetylpyridinium Chloride Monohydrate (CPC) (CAS#6004-24-6) from Sigma Aldrich, St. Louis, Mo., USA.

Polyvinyl Alcohol (PVOH) (CAS#9002-89-5) from Sigma Aldrich.

De-ionized Water (CAS#007732-18-5)

An 8.7% solids PVOH stock solution is prepared. The PVOH solution is heated and stirred before use to ensure good solubilization and homogeneous mixing, and the solution is allowed to cool to room temperature before being added to the latex agglomerates.

H53000 (10% solids, 400 g) is added to a 900 ml container (3.5" O.D., 7.0" height). The latex is mechanically mixed at 400 rpm (impeller blade 1.5" O.D. with alternating rectangular 1"×0.4" teeth parallel to the stir shaft) while CPC (0.28 M, 80 mL) is added over the course of about 20 minutes. The latex mixture is stirred at room temperature for 4 hours after complete addition of the CPC in order to prepare an agglomerated latex. Then, 120 g of the PVOH stock solution is added with continued stirring over the course of about 3 to 5 minutes. The mixture (now agglomerated) is allowed to continue to stir at room temperature for about 40 minutes. Upon completion of stirring, agglomerate sizes in the wet state are measured by dynamic light scattering. Alternatively, electron microscopy is used to determine the agglomerated particle size of the dry particle and can also be used to determine the dry agglomerated particle morphology.

Scanning electron microscopy (SEM) is performed with an Armray 1810 SEM instrument at an acceleration voltage of 20 kV. Diluted samples are prepared for analysis by adding 2 drops of the agglomerated hollow particle latex prepared above to 20 mL of deionized water. The diluted samples are then added dropwise to an SEM stub, are allowed to dry at room temperature overnight, and are plasma sputtered with a thin layer of gold to enhance the conductivity and contrast of the polymer sample under the electron beam.

Figure 1B:
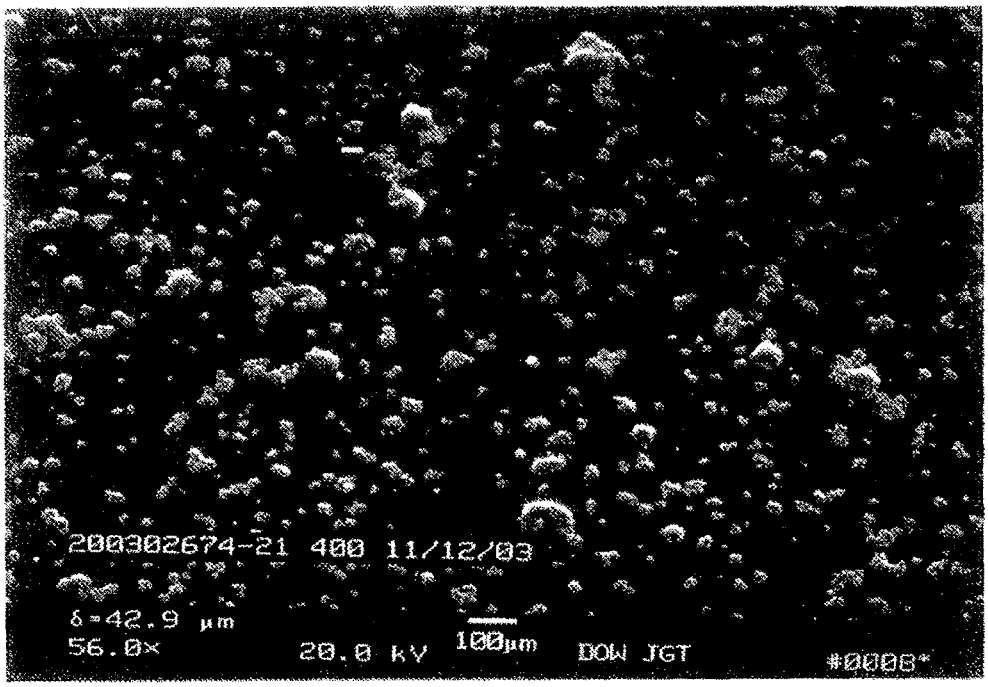

FIGS. 1A and 1B offer a direct view of the morphologies present in the aggregated sample while also giving an indication of the distribution of agglomerate size. FIG. 1B shows the dense packing of the agglomerate morphology and roughly a 10μm circular diameter for the particular agglomerate particle shown.

Figure 2A:
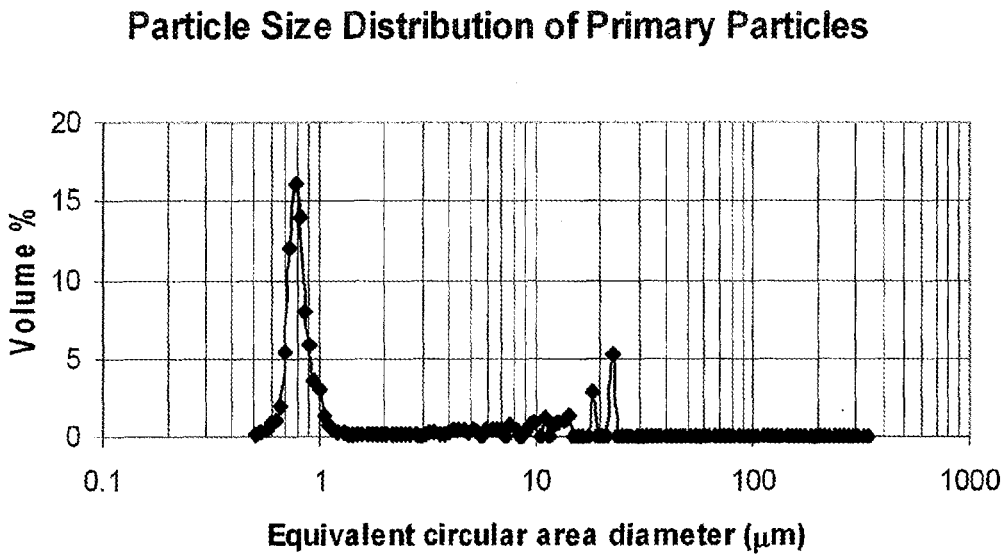
FIGS. 2A and 2B are plots of particle size distribution for a hollow particle latex and for an agglomerated hollow particle latex, respectively.
Figure 2B:
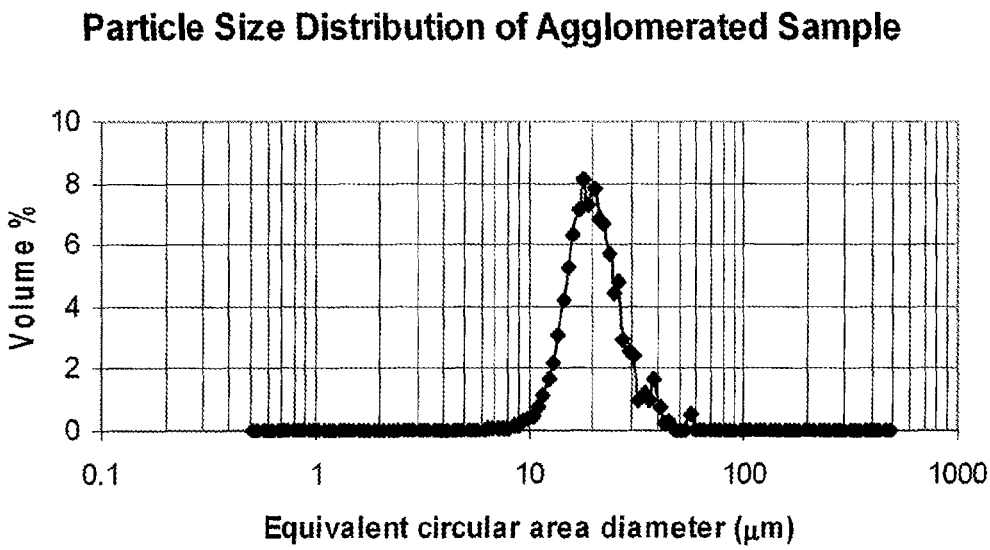

In FIG. 2A , dynamic light scattering (Particle Sizing Systems, Inc. Model 770Accusizer) is used to analyze the particle size, distribution, and percent conversion of the hollow particle latex into the agglomerated hollow particle latex. Samples are prepared for analysis by adding 1 drop of the agglomerated hollow particle latex described above to 20 mL of deionized water. Data is recorded by a computer for both the number and volume weighted particle size distributions. The number distribution profile suggests that a small percentage of un-agglomerated primary particles remain; however, the amount of un-agglomerated primary particles is quite low. To better exemplify the increase in overall particle size upon agglomeration, the volume weighted size distribution is shown in FIGS.2A and 2B, respectively for both the un-agglomerated and agglomerated sample. It is clear that the primary particles are converted to aggregates of between 10 to 30 μm (assuming circular diameter). These results are in agreement with that observed by SEM in FIG. 1A.

EXAMPLE 2

Preparation of Handsheets from Agglomerated Hollow Particle Latex

Paper handsheets are prepared using a British Standard Semiautomatic Handsheet Mold according to the method TAPPI T-205 sp-95 in order to test the performance of the agglomerated hollow particle latex. Precipitated calcium carbonate, an industry standard, is used as a control filler. A blank handsheet (i.e. no filler added) is also prepared to compare the performance of the fillers versus loading.

The sheets for this example are labeled as follows:

AGG—Agglomerated hollow particle latex from Example 1

$CaCO_3$—(Control Filler: PCC, Albacar®, a scalenohedral-shaped mineral filler from Specialty Minerals)

Blank—(no filler, this sample is shown on plots as the 0% filler data point)

Each sample is run at three different filler loadings (6%, 10%, and 15%, based on the weight of the filled paper). All fillers are added on a dry weight basis. A weight of 80 lbs/3300 $ft^2$ or 118 grams/$m^2$ is used as a target for the basis weight of the paper.

The base furnish used to make the paper is a 50/50 blend of hardwood and softwood refined to a Canadian Standard Freeness of 420. All handsheets in this example are made from the same batch of refined pulp. Approximately 20 liters of pulp at 0.5% consistency are mixed and the amount needed for each set of handsheets is drawn from this sample. Consistency pads are made in duplicate for each of the base furnishes to determine the amount needed for each sample.

Mixtures of fiber and filler are prepared for each filler loading. For the PCC control, $CaCO_3$ filler is weighed and placed in a blender for 1 minute with 700 ml of dilution water. For the agglomerated hollow particle latex , the filler is weighed, diluted, and placed in a blender for 1 minute along with an anti-foaming agent (Dow Corning ANTIFOAM 1410) to control potential foaming upon mixing. The filler is then added to the fiber furnish and diluted to 8.0 liters.

A 500 ml sample of each fiber/filler mixture is then measured and placed on a magnetic stirrer. One lb. of PERCOL 292 Cationic Retention Aid per ton of fiber/filler mixture is added to the mixture and mixed for 30 seconds. The British Standard Semi-Automatic Handsheet Mold is then started, and the fiber/filler/retention aid mixture is poured into the handsheet mold. The handsheet mold is filled to the correct height, allowed to mix, followed with a settling stage, and allowed to drain. The sheet is then removed from the wire. Twelve sheets are stacked and pressed simultaneously to form the hand sheets.

Percentage retention of the agglomerated hollow particle filler in a handsheet is determined by pyrolysis of the solid residue remaining in the water after the handsheets are pressed. The solids in the water remaining from a particular sample is dried and the percent solids is determined. A 1 mg sample of that residue is then pyrolyzed at 700° C. The amount of latex present is determined by comparing the styrene peak areas of the residue samples to that of the latex used in the experiment. The water samples are found to have less than 3 ppm of latex in their residue. The starting level of latex in the water was 100 ppm, which indicates that greater than 97% of the agglomerated hollow latex was retained in the paper handsheets.

Evaluation of End-Use Performance in Paper

A comparative analysis of the fillers is performed using the handsheets prepared. The following data exemplify the superior performance of the agglomerated hollow particle latex filler as compared to precipitated calcium carbonate filler, specifically in terms of bulking ability and optical properties. Twelve handsheets are prepared for each type of sample and the properties reported are the averages of 10 sheets based on multiple readings on each sheet.

Figure 3:
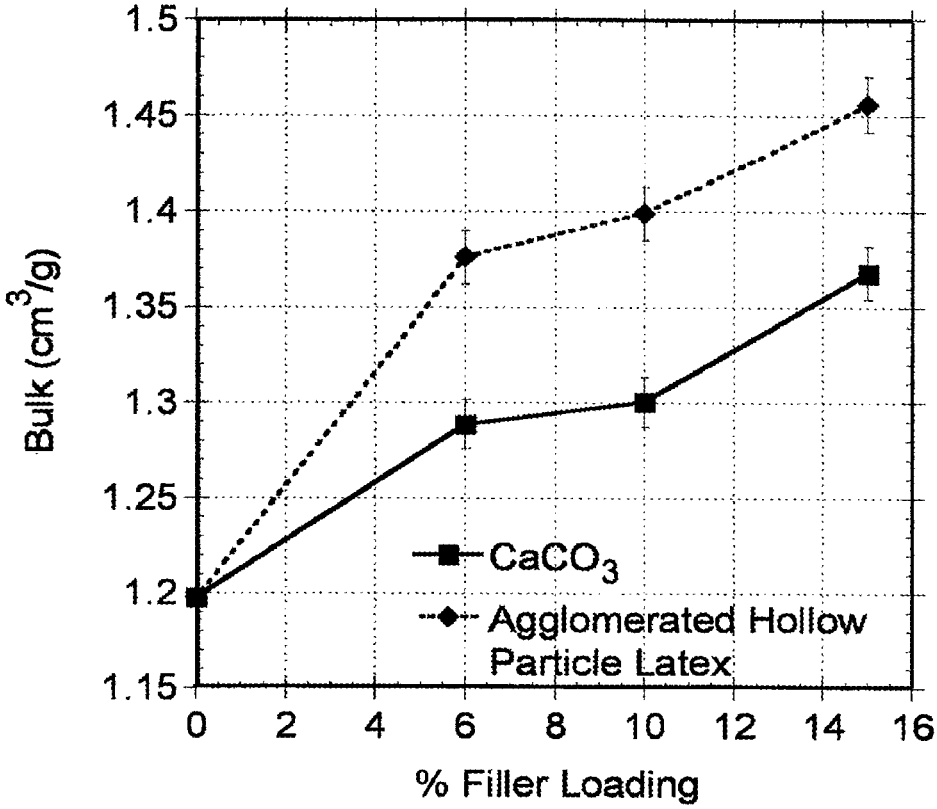
FIG. 3 is a line graph of paper bulk vs. percent filler loading.

The bulk of a sheet is measured as the quotient of its caliper to basis weight. Caliper is measured in mils, and basis weight is determined by weighing the sheet in grams and dividing by the area of the sheet in square meters. Bulk is then calculated by dividing caliper by basis weight and multiplying by 25.4 to convert to specific volume units of CM3/gram. The effects of filler loading on bulk are depicted graphically in FIG. 3. The superior bulking ability of the agglomerated hollow particle latex is apparent.

Figure 4:
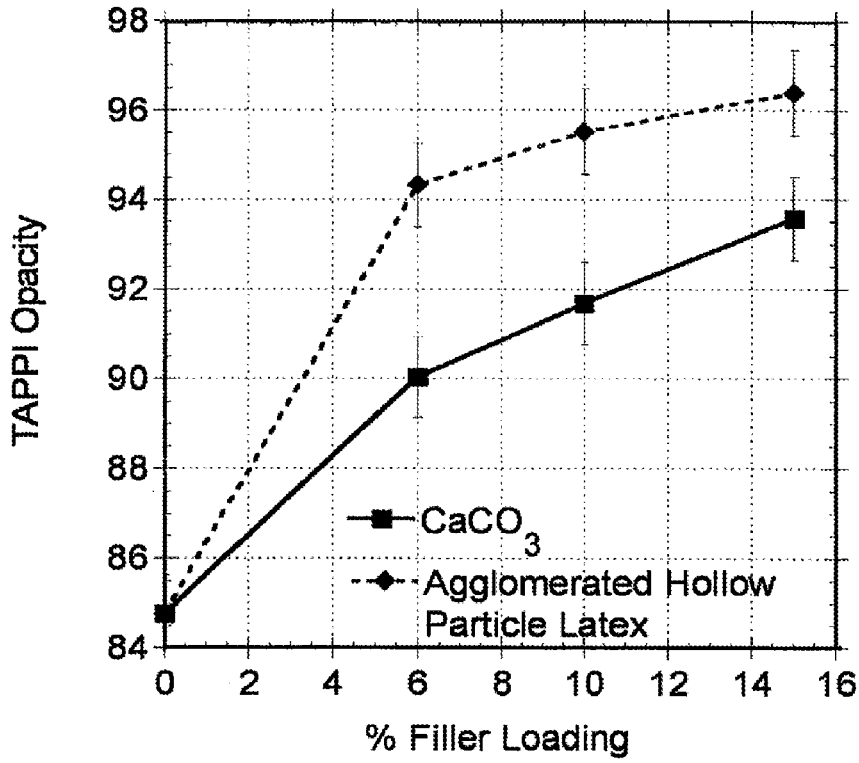
FIG. 4 is a line graph of TAPPI paper opacity vs. percent filler loading.

Opacity is measured on the handsheets by TAPPI Method T519. The results are depicted In FIG. 4, which shows that the agglomerated hollow particle latex outperforms the blank and precipitated calcium carbonate for all filler loadings.

Figure 5:
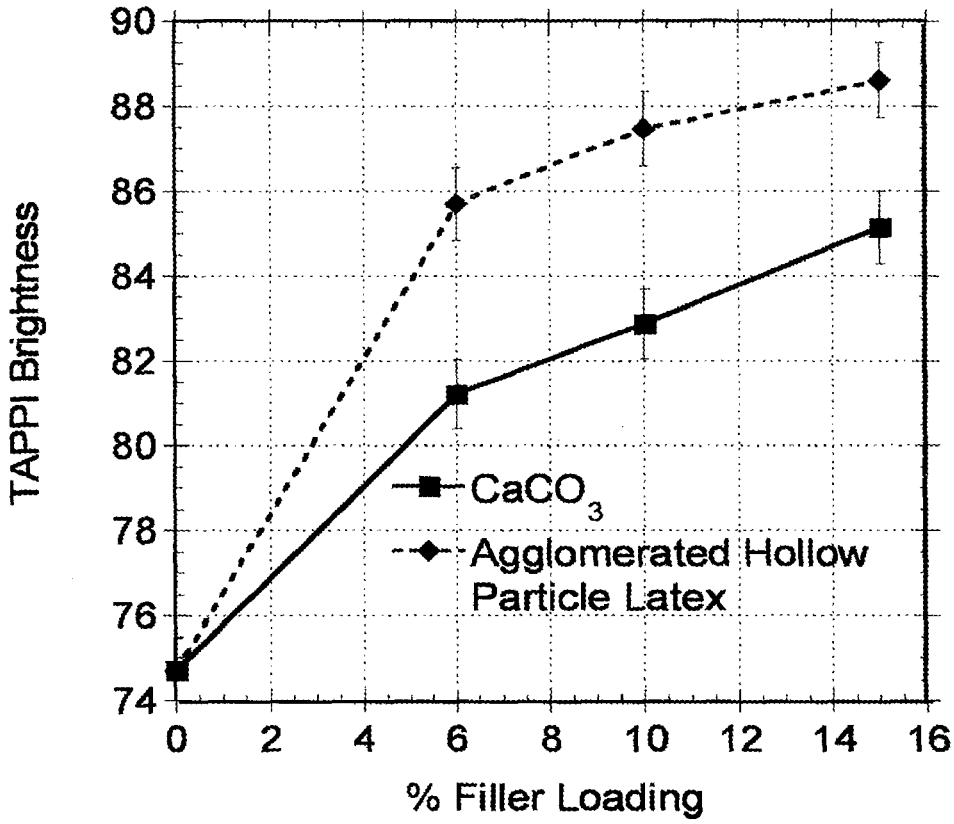
FIG. 5 is a line graph of paper brightness vs. percent filler loading.

Brightness is measured on the handsheets by TAPPI Method T452. The results are shown in FIG. 5 (TAPPI brightness versus filler loading), which shows that the agglomerated hollow particle latex filler outperforms precipitated calcium carbonate, and the blank sheet, in brightness at all concentrations.

When the agglomerated hollow is substituted for a portion of the mineral filler the handsheets are found to be smoother and feel softer to the touch (velvet like).

What is claimed is:

1. A process for making a paper material, the process comprising:

(1) providing a latex including agglomerated hollow particles;

(2) forming an aqueous slurry by introducing water, pulp, and the latex including agglomerated hollow particles, where the slurry includes a filler component that includes at least 10% by weight of the agglomerated hollow particles;

(3) forming a wet sheet from the slurry; and (4) drying the sheet to form the paper material, wherein the paper material is brighter than a paper with a filler of precipitated calcium carbonate when measured at the same filler loading, where the agglomerated hollow particle latex is modified with the addition of a stabilizing agent, wherein the stabilizing agent is selected from the group consisting of polyvinyl alcohol, carboxymethylcellulose, and starch.

2. The process of claim 1 wherein the agglomerated hollow particles have an average particle size of from about 3 to about 100 microns.

3. The process of claim 1 wherein the agglomerated hollow particles have a cationic surface charge.

4. The process of claim 1 wherein the agglomerated hollow particles have an anionic surface charge.

5. The process of claim 1 wherein the agglomerated hollow particles have a neutral surface charge.

6. The process of claim 1 wherein an additional filler is employed, and the agglomerated hollow particles comprise at least 10 weight percent of the total filler employed.

7. The process of claim 1 wherein the agglomerated hollow particles are prepared from hollow latex particles with an interior void in the range of 10-70 percent of the volume of the latex particle.

8. The process of claim 1 wherein the agglomerated hollow particles have a total void volume in the range of 30-90 percent.

9. The process of claim 1, where the stabilizing agent is a water-soluble polymer.

10. The process of claim 1, where the latex includes up to 40% by weight, based on the weight of dry solids in the latex of the stabilizing agent.

* * * * *